US009624840B2

(12) United States Patent
Kurita et al.

(10) Patent No.: US 9,624,840 B2
(45) Date of Patent: Apr. 18, 2017

(54) INTAKE AIR QUANTITY CONTROL DEVICE FOR INTERNAL COMBUSTION ENGINE

(71) Applicant: Mitsubishi Electric Corporation, Chiyoda-ku, Tokyo (JP)

(72) Inventors: Kazuhisa Kurita, Chiyoda-ku (JP); Chiaki Sugano, Chiyoda (JP); Naruhiko Kawasaki, Chiyoda-ku (JP)

(73) Assignee: Mitsubishi Electric Corporation, Chiyoda-ku, Tokyo (JP)

( * ) Notice: Subject to any disclaimer, the term of this patent is extended or adjusted under 35 U.S.C. 154(b) by 387 days.

(21) Appl. No.: 14/055,010

(22) Filed: Oct. 16, 2013

(65) Prior Publication Data

US 2014/0305404 A1 Oct. 16, 2014

(30) Foreign Application Priority Data

Apr. 16, 2013 (JP) ..... 2013-085414

(51) Int. Cl.
*F02D 11/10* (2006.01)
*F02D 9/10* (2006.01)

(52) U.S. Cl.
CPC ..... *F02D 9/1065* (2013.01); *F02D 9/107* (2013.01); *F02D 11/10* (2013.01); *F02D 11/105* (2013.01); *F02D 9/1035* (2013.01); *F02D 2011/101* (2013.01); *F02D 2011/102* (2013.01); *F02D 2011/103* (2013.01)

(58) Field of Classification Search
CPC ..... F02D 9/1065; F02D 9/107; F02D 11/10; F02D 11/105; F02D 9/1035
USPC ..... 123/337, 399, 195 R; 310/89, 51; 411/531, 545, 546
See application file for complete search history.

(56) References Cited

U.S. PATENT DOCUMENTS 4,340,830 A * 7/1982 Hoyer-Ellefsen ..... H02K 15/16 310/89
5,089,735 A * 2/1992 Sawaguchi ..... H01R 39/40 277/621
5,334,897 A * 8/1994 Ineson ..... H02K 5/08 310/401
5,490,487 A * 2/1996 Kato ..... F02D 11/10 123/399

(Continued)

FOREIGN PATENT DOCUMENTS

JP 2004-153914 A 5/2004
JP 2010-178469 A 8/2010
JP 2012-034532 A 2/2012

OTHER PUBLICATIONS

Japanese Office Action dated Dec. 17, 2013 issued in Japanese Application No. 2013-085414.

*Primary Examiner* — Thomas Moulis
*Assistant Examiner* — Susan E Scharpf
(74) *Attorney, Agent, or Firm* — Sughrue Mion, PLLC; Richard C. Turner

(57) ABSTRACT

In the intake air quantity control device, a ring-shaped convex portion having an outer diameter being smaller than an inner diameter of the wave washer for damping the drive motor is formed on the bottom surface of the cylinder-shaped hole of the throttle body, and tapered portions are provided at an outer-diameter corner of the ring-shaped convex portion and at an outer-diameter corner of the bottom surface of the cylinder-shaped hole of the throttle body.

6 Claims, 4 Drawing Sheets

(56) References Cited

U.S. PATENT DOCUMENTS

| | | | | |
|---|---|---|---|---|
| 5,945,756 | A * | 8/1999 | Periyathamby | H02K 5/143 310/43 |
| 6,348,752 | B1 * | 2/2002 | Erdman | H02K 11/40 310/194 |
| 6,390,062 | B1 * | 5/2002 | Saito et al. | 123/399 |
| 6,486,580 | B1 * | 11/2002 | Cenzer | H02K 5/141 310/239 |
| 6,626,143 | B1 * | 9/2003 | Wayama | F02D 9/00 123/399 |
| 6,880,231 | B2 * | 4/2005 | Campbell | H02K 1/30 29/596 |
| 6,912,994 | B2 * | 7/2005 | Ozeki et al. | 123/399 |
| 6,945,228 | B2 * | 9/2005 | Saito et al. | 123/399 |
| 6,966,297 | B2 * | 11/2005 | Wayama et al. | 123/399 |
| 6,986,336 | B2 * | 1/2006 | Tanimura et al. | 123/343 |
| 6,997,163 | B2 * | 2/2006 | Arai et al. | 123/399 |
| 7,051,707 | B2 * | 5/2006 | Tanimura et al. | 123/361 |
| 7,213,557 | B2 * | 5/2007 | Kondo et al. | 123/184.53 |
| RE40,382 | E * | 6/2008 | Sato | F02D 11/10 123/399 |
| 7,832,373 | B2 * | 11/2010 | Enomoto | F02D 41/0055 123/336 |
| 2004/0170346 | A1 * | 9/2004 | Komeda et al. | 384/479 |
| 2007/0103010 | A1 * | 5/2007 | Kouzu | H02K 5/24 310/51 |
| 2013/0063137 | A1 * | 3/2013 | Ikeda et al. | 324/207.25 |
| 2013/0106114 | A1 * | 5/2013 | Wang et al. | 290/1 A |

* cited by examiner

INTAKE AIR QUANTITY CONTROL DEVICE FOR INTERNAL COMBUSTION ENGINE

BACKGROUND OF THE INVENTION

Technical Field

The present invention relates to an intake air quantity control device for an internal combustion engine, and particularly relates to an intake air quantity control device for an internal combustion engine, which controls an aperture ratio of a throttle valve by a driving unit including a drive motor.

Background Art

In conventional intake air quantity control devices in this family, there is a known intake air quantity control device in which a drive motor is assembled in a throttle body forming an intake air passage of an internal combustion engine, and a gear joined to a motor shaft of the drive motor is linked to a throttle shaft of a throttle valve, and the throttle shaft is rotated at an arbitrary angle by rotating the drive motor, whereby an aperture ratio of the throttle valve provided in the intake air passage is controlled.

In order to improve a vibration-proof capability of a conventional drive motor, an intake air quantity control device for an internal combustion engine, in which a component for damping a vibration (for example, a wave washer or the like) is provided between a bottom surface of the drive motor and a throttle valve, is disclosed (for example, refer to Patent Document 1).

Meanwhile, it has been a problem in recent years that various actuators must be miniaturized in order to reduce space in an engine room, so that there is a conventional system, as a countermeasure for solving the problem, in which an intake air quantity control device can be miniaturized by adopting a flat motor in which the outer diameter of the drive motor is partly flattened.

CONVENTIONAL ART DOCUMENT

Patent Document

Japanese Laid-Open Patent Publication No. 2004-153914

SUMMARY OF THE INVENTION

Problems to be Solved by the Invention

As described above, when a flat motor, which the outer diameter of the drive motor is partly flattened, is adopted, an outer diameter of a wave washer, for damping a vibration, which is used in a conventional device described in Patent Document 1, must be shorter than a width of a flat portion of the drive motor. In this case, when the wave washer is fitted to a throttle body, looseness of the wave washer in an outer diameter direction of a cylinder of the drive motor is increased in accordance with a size of an outer diameter of the wave washer and a size of an outer diameter of the cylinder of the drive motor, so that center positions of the drive motor and the wave washer are substantially deviated each other, and there has been a problem in that accuracy of fitting the drive motor to the throttle body is decreased by generating a trouble in which loads are unbalanced or the drive motor overridden on the wave washer. Meanwhile, although the accuracy for fitting the drive motor to the throttle body is increased when the center positions of the drive motor and the wave washer are accurately identical each other, there has been a problem in that a work, by which the center positions of the drive motor and the wave washer become accurately identical, is required, and a workability of fitting the drive motor is decreased.

The present invention has been made to solve above-described problems in conventional intake air quantity control devices for an internal combustion engine, and an object of the invention is to provide an intake air quantity control device for an internal combustion engine having a configuration by which a workability of fitting a drive motor to a throttle body can be improved, and a reliability of a product can be improved.

Means for Solving Problems

An intake air quantity control device for an internal combustion engine of the present invention, includes a throttle shaft on which a throttle valve, which is provided in an intake air passage of the internal combustion engine, is arranged so as to be freely rotated and supported; throttle gear that is fixed to the throttle shaft; a pinion gear that is engaged to the throttle gear; a drive motor that includes a motor shaft, to which the pinion gear is fixed, and is freely rotated at an arbitrary angle; throttle body that includes a cylinder-shaped hole having a bottom surface and houses the drive motor in the cylinder shaped hole; and a washer that is arranged between the drive motor and the bottom surface of the cylinder-shaped hole; wherein an aperture ratio of the throttle valve is regulated by rotating the throttle shaft by the drive motor so as to control intake air of the internal combustion engine, and the throttle body includes a position setting means for setting an arrangement position of the washer at the bottom surface of the cylinder-shaped hole.

Effects of the Invention

According to the intake air quantity control device for the internal combustion engine of the present invention, a position setting means for setting an arrangement position of a washer is provided at a bottom surface of a cylinder-shaped hole of a throttle body, so that the washer can be easily and accurately arranged at the bottom surface of the cylinder-shaped hole of the throttle body, and arrangement accuracy of the intake air quantity control device can be improved.

DETAILED DESCRIPTION OF THE PREFERRED EMBODIMENTS

Hereinafter, each of embodiments of the present invention will be explained in reference to drawings. In addition, reference symbols, which are the same as those in each of the drawings, refer to the same or equivalent components or equivalent parts so as to be explained.

Embodiment 1

Figure 1:
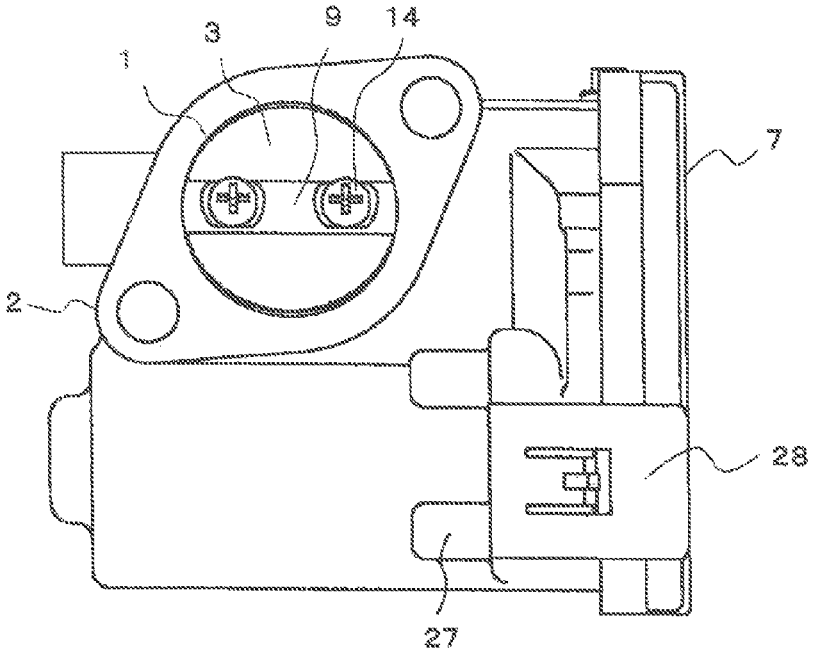
FIG. 1 is a front view illustrating an intake air quantity control device for an internal combustion engine according to Embodiment 1 of the present invention.
Figure 2:
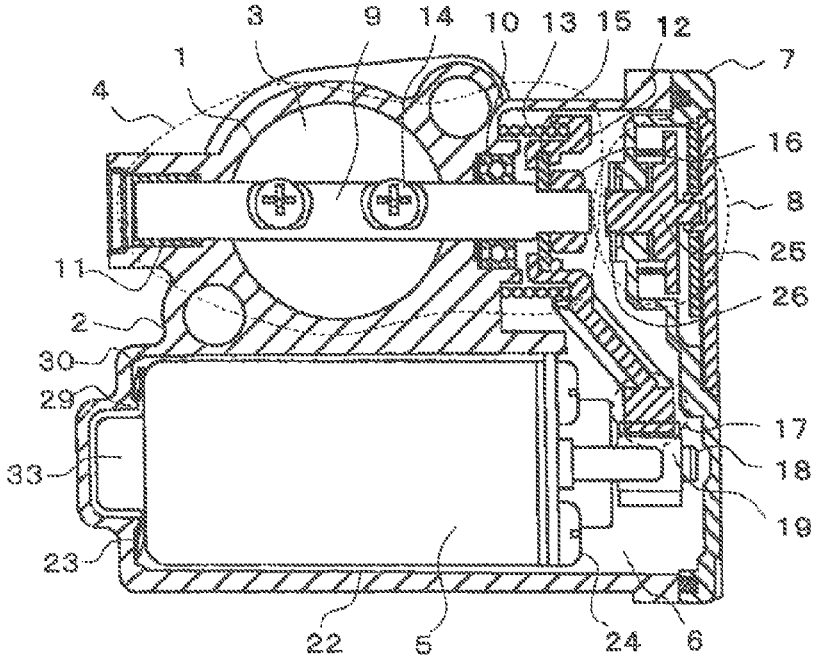
FIG. 2 is a front cross-sectional view illustrating the intake air quantity control device for the internal combustion engine according to Embodiment 1 of the present invention.
Figure 3:
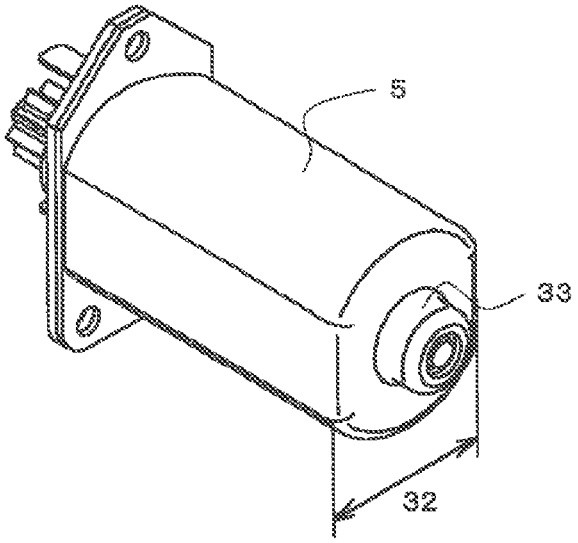
FIG. 3 is an explanatory view illustrating a drive motor in the intake air quantity control device for the internal combustion engine according to Embodiment 1 of the present invention.
Figure 4:
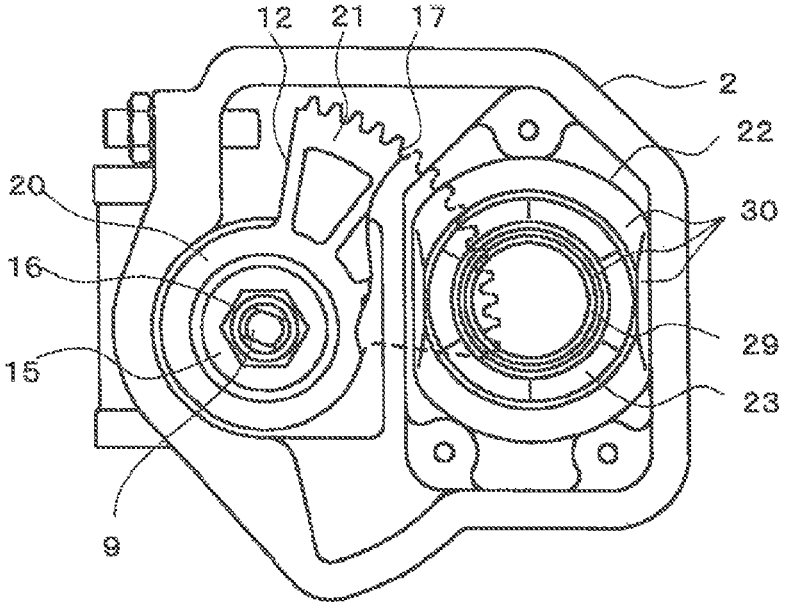
FIG. 4 is an explanatory view illustrating the intake air quantity control device for the internal combustion engine, in a state where a cover and the drive motor of the intake air quantity control device are dismounted, according to Embodiment 1 of the present invention.
Figure 5:
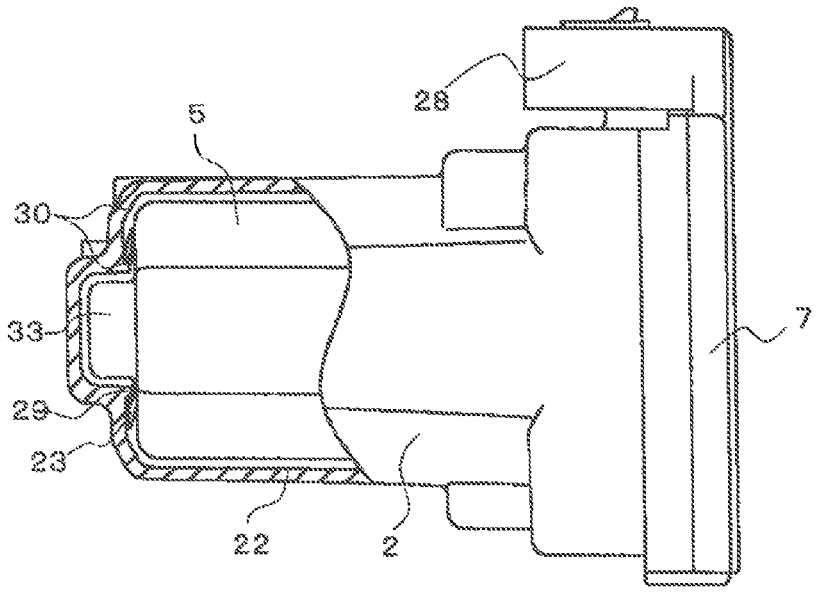
FIG. 5 is a cross-sectional view illustrating a part of the intake air quantity control device for the internal combustion engine according to Embodiment 1 of the present invention.

FIG. 1 is a front view illustrating an intake air quantity control device for an internal combustion engine according to Embodiment 1 of the present invention; FIG. 2 is a front cross-sectional view illustrating the intake air quantity control device for the internal combustion engine according to Embodiment 1 of the present invention; FIG. 3 is an explanatory view illustrating a drive motor in the intake air quantity control device for the internal combustion engine according to Embodiment 1 of the present invention; FIG. 4 is an explanatory view illustrating the intake air quantity control device for the internal combustion engine, in a state where a cover and the drive motor of the intake air quantity control device are dismounted, according to Embodiment 1 of the present invention; and FIG. 5 is a cross-sectional view illustrating a part of the intake air quantity control device for the internal combustion engine according to Embodiment 1 of the present invention. In FIG. 1 through FIG. 5, a throttle body 2 is made from, for example, die-casting aluminum or a resin mold, and includes an intake air passage 1 which is a part of an intake air system of the internal combustion engine (not illustrated).

The throttle body 2 includes a throttle valve component 4, which supports a throttle valve 3 so as to be opened or closed, a drive motor 5 for driving the throttle valve 3, and a drive chamber 6 for housing a power transmission mechanism composed of a pinion gear, a throttle gear and the like, and is configured in such a way that only a part (a right end portion in FIG. 1) of the throttle body 2 is opened. The opened portion of the throttle body 2 is covered by a cover 7 made of, for example, a resin mold. A rotational angle detector 8 for detecting a rotational angle of the throttle valve 3 is installed in the cover 7. The intake air passage 1 formed in the throttle body 2 has a circular-cross-section shape, and is extended in a vertical direction to a plane of this paper in FIG. 1 and FIG. 2.

The throttle valve component 4 includes a throttle shaft 9; a first bearing 10 by which one end portion (right end portion in FIG. 1 and FIG. 2) of the throttle shaft 9 is freely rotated and supported; a second bearing 11 by which the other end portion (left end portion in FIG. 1 and FIG. 2) of the throttle shaft 9 is freely rotated and supported; the throttle valve 3 having a butterfly shape, which opens or closes the intake air passage 1 in accordance with the rotation of the throttle shaft 9; and a return coil spring 13, provided between a throttle gear 12 and the throttle body 2, which keeps a rotational force in accordance with the rotation in a predetermined direction of the throttle shaft 9 and rotates the throttle shaft 9 in a reverse direction with respect to the predetermined direction so as to returns the throttle shaft 9 to its original rotational position when the rotational force is lost.

The throttle shaft 9 is arranged in such a way that its axial line is orthogonal to the intake air passage 1. The throttle shaft 9 is freely rotated and supported around the axial line by the first bearing 10 and the second bearing 11. The first bearing 10 is composed of a ball bearing arranged at one end portion of the throttle shaft 9, and the second bearing 11 is composed of a metal bearing arranged at the other end portion of the throttle shaft 9.

The throttle valve 3 is composed of a circular plate of which cross-sectional area is nearly equal to a cross-sectional area of the intake air passage 1, and is arranged so as to cross the intake air passage 1. The throttle valve 3 is fixed to the throttle shaft 9 by a screw 14, and is rotated with the throttle shaft 9. An aperture ratio of the throttle valve 3 is varied in accordance with a rotational position of the throttle valve 3, whereby an intake air quantity of the internal combustion engine is controlled.

The throttle gear 12 provided at one end portion of the throttle shaft 9 is made of a resin mold, and includes, as described later, a supporting portion 20 having a ring shape, and a fan-shaped portion 21 which is integrally formed at a portion of cuter surface of the supporting portion 20 and has a gear-tooth portion 17 at the outer surface. An inner surface of the supporting portion 20 of the throttle gear 12 is fitted to an outer surface of an insert unit 15 fixed to the throttle shaft 9. Moreover, the throttle gear 12 is fixed, by a nut 16 via the insert unit 15, to one end portion of the throttle shaft 9, and is integrally rotated with the throttle shaft 9 via the insert unit 15 in accordance with the rotation of the throttle shaft 9.

The gear-tooth portion 17 of the throttle gear 12 is configured in such a way that the gear-tooth portion 17 is engaged to a pinion gear 19 provided on a motor shaft 18 of the drive motor 5, and a rotational velocity of the drive motor 5 is reduced and transmitted to the throttle shaft 9.

The above-described throttle gear 12 is composed of the supporting portion 20 having a ring shape, by which the insert unit 15 is fitted to the throttle shaft 9, and the fan-shaped portion 21 having a fan-shaped portion 21. As clearly indicated in FIG. 2, the fan-shaped portion 21 is offset in an axial direction of the throttle shaft 9 with respect to the supporting portion 20.

The drive motor 5, in which the outer diameter 32 of the drive motor 5 is partly flattened, as shown in FIG. 3, is fixed to a lower portion of the throttle body 2 in such a way that the motor shaft 18 of the drive motor 5 is parallel with the throttle shaft 9. The drive motor 5 is driven by an instruction from an external device, and rotates the throttle shaft 9, via a power transmission mechanism including the pinion gear 19, the throttle gear 12 and the like, in a predetermined direction opposing to a bias force of the return coil spring 13, whereby an aperture ratio of the throttle valve 3 is increased or decreased. When a driving force of the drive motor 5 is lost, the throttle shaft 9 is rotated, by the accumulated bias force of the return coil spring 13, in a reverse direction with respect to the predetermined direction so as to be returned.

A wave washer 23 used as a washer is inserted between a bottom surface of the drive motor 5 and a bottom surface of a cylinder-shaped hole 22 used as a cylinder-shaped hole of the throttle body 2. The drive motor 5 is fixed to the throttle body 2 by three attaching screws 24 in a state where the wave washer 23 is compressed.

Moreover, a ring-shaped convex portion 29 having an outer diameter, which is smaller than an inner diameter of the wave washer 23, is formed on the bottom surface of the cylinder-shaped hole 22 of the throttle body 2. Tapered portions 30 are provided at an outer-diameter corner of the ring-shaped convex portion 29 and at an outer-diameter corner of the bottom surface of the cylinder-shaped hole 22 of the throttle body 2. The convex portion. 29 is formed as a position setting means of the present invention.

The rotational angle detector 8 integrated with the cover 7 includes a rotor 25 that is freely rotated and supported by the cover 7, and the rotational angle detector 8 is arranged in such a way that t an axis of the rotor 25 is identical to an axis of the throttle shaft 9 when the cover 7 is fixed to the throttle body 2. Moreover, a lever 26 is fixed to an end portion of the rotor 25, which faces an end portion of the throttle shaft 9. The lever 26 is fitted to a portion of the fan-shaped portion 21 of the throttle gear 12, and follows the throttle shaft 9 so a be rotated.

Moreover, a motor terminal 27 for electrically connecting the drive motor 5 is formed in a protrusion shape on the cover 7. Furthermore, a connector 28, by which the drive motor 5 and the rotational angle detector 8 are electrically linked to an external device, is formed on the cover 7.

As described above, in the intake air quantity control device for the internal combustion engine according to Embodiment 1 of the present invention, a ring-shaped convex portion 29 having an outer diameter, which is smaller than an inner diameter of the wave washer 23 for damping the drive motor 5, is formed on the bottom surface of the cylinder-shaped hole 22 of the throttle body 2, so that the inner diameter of the wave washer 23 is positioned along the outer diameter of the ring-shaped convex portion 29 of the throttle body 2 when the wave washer 23 is arranged on the bottom surface of the cylinder-shaped hole 22 of the throttle body 2, whereby the wave washer 23 can be easily and accurately assembled, and assembly accuracy can be improved.

Figure 8:
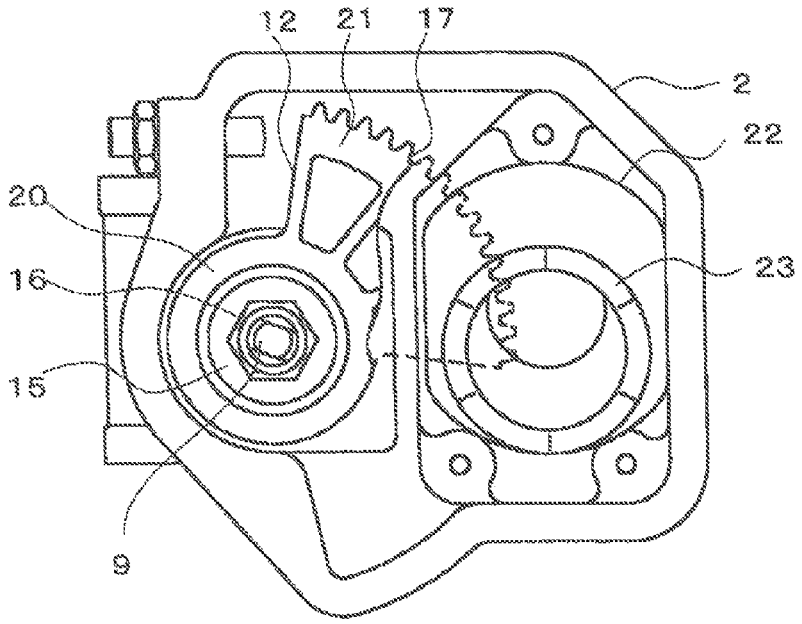
FIG. 8 PRIOR ART
FIG. 8 is an explanatory view illustrating a conventional intake air quantity control device for an internal combustion engine, in a state where a cover and a drive motor of the intake air quantity control device are dismounted.

Moreover, the ring-shaped convex portion 29 having the outer diameter, which is smaller than the inner diameter of the wave washer 23 for damping the drive motor 5, is formed on the bottom surface of the cylinder-shaped hole 22 of the throttle body 2, so that the inner diameter of the wave washer 23 is positioned along the outer diameter of the ring-shaped convex portion 29 of the throttle body 2 when the wave washer 23 is arranged on the bottom surface of the cylinder-shaped hole 22 of the throttle body 2, whereby the wave washer 23 is not substantially deviated as indicated in a conventional device illustrated in FIG. 8, and center axis of the drive motor 5 is easily identical to a center axis of the wave washer 23. Therefore, a constant generation weight of the wave washer 23 can be expected, and a fear of assembling the drive motor 5, in a state where the drive motor 5 is positioned over the wave washer 23, can be eliminate, whereby a reliability of a product can be improved.

Moreover, the tapered portions 30 are provided at the outer-diameter corner of the ring-shaped convex portion of the throttle body 2 and at the outer-diameter corner of the bottom surface of the cylinder-shaped hole 22 of the throttle body 2, so that the wave washer 23 is suitably set, by its own weight, at an arrangement position only by inserting the wave washer 23 into the cylinder-shaped hole 22 of the throttle body 2. Therefore, a man-hour for a work, such as an accurate positioning work, is not required after the wave washer 23 is inserted, and an assembling capability of the device can be substantially improved.

Moreover, in the intake air quantity control device for the internal combustion engine according to Embodiment 1 of the present invention, the ring-shaped convex portion having the outer diameter, which is smaller than the inner diameter of the wave washer for damping the drive motor, is formed on the bottom surface of the cylinder-shaped hole of the throttle body, so that the inner diameter of the wave washer is positioned along the outer diameter of the ring-shaped convex portion of the throttle body when the wave washer is arranged on the bottom surface of the cylinder-shaped hole of the throttle body, whereby a center axis of the drive motor is easily identical to a center axis of the wave washer. Therefore, a constant generation weight of the wave washer can be expected, and a fear of assembling the drive motor, in a state where the drive motor is positioned over the wave washer, can be eliminate, whereby a reliability of the product can be improved.

Moreover, in the intake air quantity control device for the internal combustion engine according to Embodiment 1 of the present invention, the tapered portions are provided at the outer-diameter corner of the ring-shaped convex portion and at the outer-diameter corner of the bottom surface of the cylinder-shaped hole of the throttle body, so that the wave washer is suitably set, by its own weight, at an arrangement position only by inserting the wave washer into the cylinder-shaped hole of the throttle body. Therefore, a man-hour for a work, such as an accurate positioning work, is not required after the wave washer is inserted, and an assembling capability of the device can be substantially improved.

Embodiment 2

Figure 6:
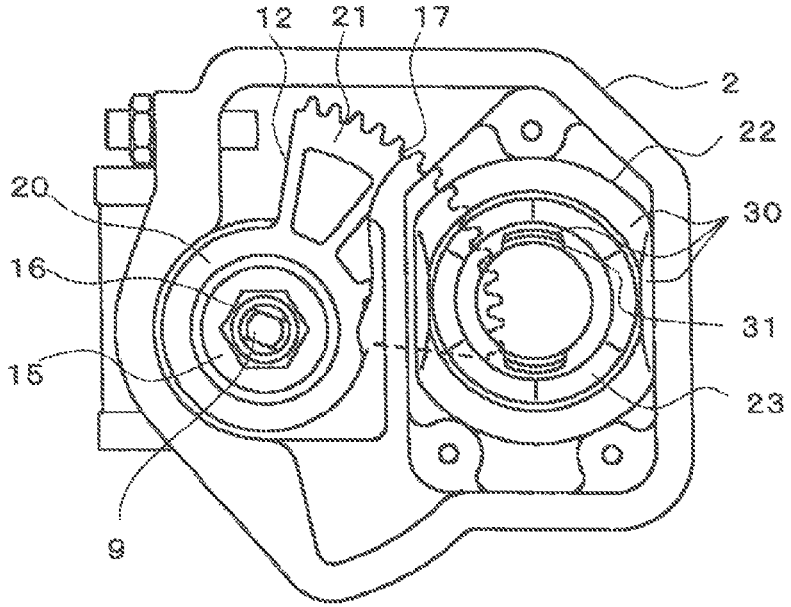
FIG. 6 is an explanatory view illustrating an intake air quantity control device for an internal combustion engine, in a state where a cover and a drive motor of the intake air quantity control device are dismounted, according to Embodiment 2 of the present invention.

FIG. 6 is an explanatory view illustrating an intake air quantity control device for an internal combustion engine, in a state where a cover and a drive motor of the intake air quantity control device are dismounted, according to Embodiment 2 of the present invention. In FIG. 6, although a convex portion, which regulates a position of a wave washer 23, is provided on a bottom surface of a cylinder-shaped hole 22 of a throttle body 2 in a similar way as described in Embodiment 1, the convex portion is different from the ring-shaped convex portion 29 described in Embodiment 1, and half-moon-shaped convex portions 31, which are formed along a partial portion of a virtual ring having an outer diameter being smaller than an inner diameter of the wave washer 23, are arranged at two positions, which are faced each other, intervening a center of the cylinder-shaped hole 22. In addition, the convex portions 31 may be arranged at more than two positions. The convex portions 31 are formed as a position setting means of the present invention.

As described above, each form of the convex portions 31 is not limited to a ring shape indicated in a case of Embodiment 1. Even when the convex portions 31, which are simply formed as indicated in Embodiment 2, are arranged at two positions or at more than two positions, the same effect indicated in Embodiment 1 can be realized.

Embodiment 3

Figure 7:
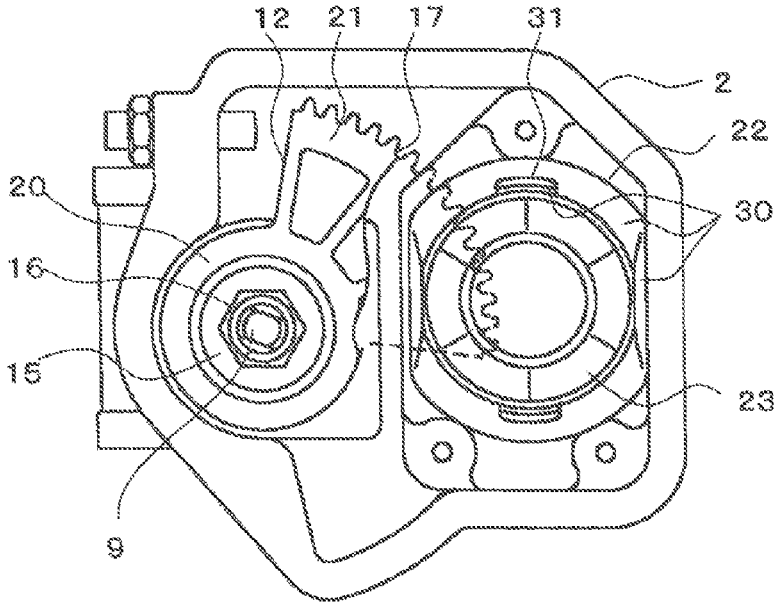
FIG. 7 is an explanatory view illustrating an intake air quantity control device for an internal combustion engine, in a state where a cover and a drive motor of the intake air quantity control device are dismounted, according to Embodiment 3 of the present invention.

FIG. 7 is an explanatory view illustrating an intake air quantity control device for an internal combustion engine, in a state where a cover and a drive motor of the intake air quantity control device are dismounted, according to Embodiment 3 of the present invention. In FIG. 7, although two convex portions 31, which regulate a position of a wave washer 23 used in a similar way described in Embodiment 2, are provided on a bottom surface of a cylinder-shaped hole 22 of a throttle body 2, half-moon-shaped convex portions 31, which are formed along a partial portion of a virtual ring having an inner diameter being larger than an outer diameter of the wave washer 23, are arranged at two positions in a case of Embodiment 3, which are faced each other, intervening a center of the cylinder-shaped hole 22. When an inner diameter of the wave washer 23 is small in accordance with a specification of the wave washer 23, or when an outer diameter of a rear-end convex portion 33 of a drive motor 5 is large in a state where the convex portions 31 cannot be arranged inside the wave washer 23 as described in Embodiment 1 and Embodiment 2, the same effect described in Embodiment 1 and Embodiment 2 can be realized by arranging two or more than two convex portions 31 at an outside of the wave washer 23 as described in Embodiment 3, The convex portions 31 are formed as a position setting means of the present invention.

The intake air quantity control device for the internal combustion engine of the present invention can be applied not only to a control device of an intake air system but also to various actuators using a drive motor and a wave washer (or a plate spring) In addition, in the scope of the present invention, it is possible that each of embodiments is freely combined, or each of embodiments is suitably modified or omitted.

What is claimed is:

1. An intake air quantity control device for an internal combustion engine, comprising:

a throttle shaft on which a throttle valve, which is provided in an intake air passage of the internal combustion engine, is arranged so as to be freely rotated and supported;

a throttle gear that is fixed to the throttle shaft;

a pinion gear that is engaged to the throttle gear;

a drive motor that includes a motor shaft, to which the pinion gear is fixed, and is freely rotated at an arbitrary angle;

a throttle body that includes a cylinder-shaped hole having a bottom surface and houses the drive motor in the cylinder-shaped hole; and a wave washer that is arranged between the drive motor and the bottom surface of the cylinder-shaped hole, in contact with the bottom surface of the cylinder-shaped hole; wherein an aperture ratio of the throttle valve is regulated by rotating the throttle shaft by the drive motor so as to control intake air of the internal combustion engine, and the throttle body includes a position setting means, composed of a convex portion extending from the bottom surface of the cylinder-shaped hole inside of a diameter of the cylinder-shaped hole, for setting an arrangement position of the wave washer at the bottom surface of the cylinder-shaped hole, and wherein the convex portion is composed of a ring-shaped convex portion having an inner diameter which is larger than an outer diameter of the wave washer, and the arrangement position of the wave washer is set by fitting an outer circumferential surface of the wave washer to an inner circumferential surface of the convex portion.

2. The intake air quantity control device according to claim 1, wherein at least one of the inner circumferential surface of the convex portion and a wall surface surrounding the bottom surface of the throttle body includes a tapered portion.

3. The intake air quantity control device according to claim 1, wherein the convex portion extends from the bottom surface of the cylinder-shaped hole in a direction toward the pinion gear.

4. An intake air quantity control device for an internal combustion engine, comprising:

a throttle shaft on which a throttle valve, which is provided in an intake air passage of the internal combustion engine, is arranged so as to be freely rotated and supported;

a throttle gear that is fixed to the throttle shaft;

a pinion gear that is engaged to the throttle gear;

a drive motor that includes a motor shaft, to which the pinion gear is fixed, and is freely rotated at an arbitrary angle;

a throttle body that includes a cylinder-shaped hole having a bottom surface and houses the drive motor in the cylinder-shaped hole; and a washer that is arranged between the drive motor and the bottom surface of the cylinder-shaped hole, in contact with the bottom surface of the cylinder-shaped hole; wherein an aperture ratio of the throttle valve is regulated by rotating the throttle shaft by the drive motor so as to control intake air of the internal combustion engine, and the throttle body includes a position setting means, composed of a convex portion extending from the bottom surface of the cylinder-shaped hole inside of a diameter of the cylinder-shaped hole, for setting an arrangement position of the washer at the bottom surface of the cylinder-shaped hole, and wherein the washer is formed in a ring shape, and the convex portion is composed of a plurality of convex portions formed along a partial portion of a virtual ring having an outer diameter which is smaller than an inner diameter of the washer, and the arrangement position of the washer is set by fitting an inner circumferential surface of the washer to outer surfaces of the plurality of convex portions.

5. The intake air quality control device accordingly to claim 4, wherein the washer is a wave washer.

6. An intake air quantity control device for an internal combustion engine, comprising:

a throttle shaft on which a throttle valve, which is provided in an intake air passage of the internal combustion engine, is arranged so as to be freely rotated and supported;

a throttle gear that is fixed to the throttle shaft;

a pinion gear that is engaged to the throttle gear;

a drive motor that includes a motor shaft, to which the pinion gear is fixed, and is freely rotated at an arbitrary angle;

a throttle body that includes a cylinder-shaped hole having a bottom surface and houses the drive motor in the cylinder-shaped hole; and a washer that is arranged between the drive motor and the bottom surface of the cylinder-shaped hole, wherein an aperture ratio of the throttle valve is regulated by rotating the throttle shaft by the drive motor so as to control intake air of the internal combustion engine, and the throttle body includes a position setting means for setting an arrangement position of the washer at the bottom surface of the cylinder-shaped hole, and wherein the washer is formed in a ring shape, and the position setting means is composed of a plurality of convex portions formed along a partial portion of a virtual ring having an inner diameter which is larger than an outer diameter of the washer, and the arrangement position of the washer is set by fitting an outer circumferential surface of the washer to an inner circumferential surface of the convex portions.

* * * * *